US010626671B2

(12) United States Patent
Crowell

(10) Patent No.: US 10,626,671 B2
(45) Date of Patent: Apr. 21, 2020

(54) ADAPTABLE LADDER ACCESSORY

(71) Applicant: Jones Lang LaSalle IP, Inc., Chicago, IL (US)

(72) Inventor: David V. Crowell, Roseville, CA (US)

(73) Assignee: JONES LANG LASALLE IP, INC., Chicago, IL (US)

( * ) Notice: Subject to any disclaimer, the term of this patent is extended or adjusted under 35 U.S.C. 154(b) by 0 days.

(21) Appl. No.: 15/912,057

(22) Filed: Mar. 5, 2018

(65) Prior Publication Data

US 2019/0271191 A1 Sep. 5, 2019

(51) Int. Cl.
*E06C 7/00* (2006.01)
*G09F 7/18* (2006.01)

(52) U.S. Cl.
CPC ..... *E06C 7/003* (2013.01); *G09F 7/18* (2013.01); *G09F 2007/1856* (2013.01)

(58) Field of Classification Search
CPC ..... E06C 7/003; G09F 7/18; G09F 2007/1856
See application file for complete search history.

(56) References Cited

U.S. PATENT DOCUMENTS 361,212 A * 4/1887 Dormitzer ..... E06C 9/10 182/21
758,146 A * 4/1904 Peterson ..... A41F 3/00 2/310
2,792,228 A * 5/1957 Chaikin ..... A63F 1/06 273/148 A
3,311,195 A * 3/1967 Singer ..... E06C 1/18 182/106
3,372,772 A * 3/1968 Singer ..... E04H 4/06 182/106
3,784,139 A * 1/1974 Ellis ..... E06C 7/143 248/210
5,441,126 A * 8/1995 Orrick ..... E06C 7/006 182/106
6,351,893 B1 * 3/2002 St. Pierre ..... B43L 13/201 33/16
6,516,546 B1 * 2/2003 Bremick ..... E06C 7/006 182/129
D549,839 S * 8/2007 Zodnik ..... D25/68
7,819,248 B1 * 10/2010 Takach ..... E06C 7/146 206/419
D627,486 S * 11/2010 O'Connell, Sr. ..... D25/68
D635,042 S * 3/2011 Phillips ..... D10/74
D700,715 S * 3/2014 Kubik ..... D25/68
8,720,644 B2 * 5/2014 Naranjo ..... E06C 7/006 182/106
8,720,844 B2 * 5/2014 Westimayer ..... F16M 13/02 248/218.4
D757,301 S * 5/2016 Van Oers ..... D25/68
2002/0117521 A1 * 8/2002 Brandt ..... A45F 5/00 224/247
2002/0157272 A1 * 10/2002 Haegele ..... F02F 1/24 33/563

(Continued)

*Primary Examiner* — Cassandra Davis
(74) *Attorney, Agent, or Firm* — Pepper Hamilton LLP

(57) ABSTRACT

A ladder accessory is easily adapted for mounting on ladders of different shapes and sizes. The ladder accessory includes mounting slots whose long dimensions run in at least two different directions. This allows mounting hardware to be placed anywhere along the length of the slot, as may be convenient for a particular ladder's geometry.

12 Claims, 5 Drawing Sheets

(56) References Cited

U.S. PATENT DOCUMENTS

| | | | | |
|---|---|---|---|---|
| 2016/0047166 | A1* | 2/2016 | Payne | E06C 7/14<br>248/205.2 |
| 2016/0186493 | A1* | 6/2016 | Young | E06C 7/006<br>182/230 |

* cited by examiner

ADAPTABLE LADDER ACCESSORY

FIELD

This disclosure is in the field of accessories for ladders.

BACKGROUND

Ladders come in a variety of shapes and sizes. In particular, the dimensions of a ladder are largely determined by its intended purpose. The variety of ladder shapes and sizes makes it difficult to design universal accessories which can be fitted to a variety of ladder shapes and sizes.

SUMMARY

This disclosure describes a ladder accessory which is easily adapted for mounting on ladders of different shapes and sizes. The ladder accessory includes mounting slots whose long dimensions run in at least two different directions. This allows mounting hardware to be placed anywhere along the length of the slot, as may be convenient for a particular ladder's geometry.

DETAILED DESCRIPTION

Figure 1:
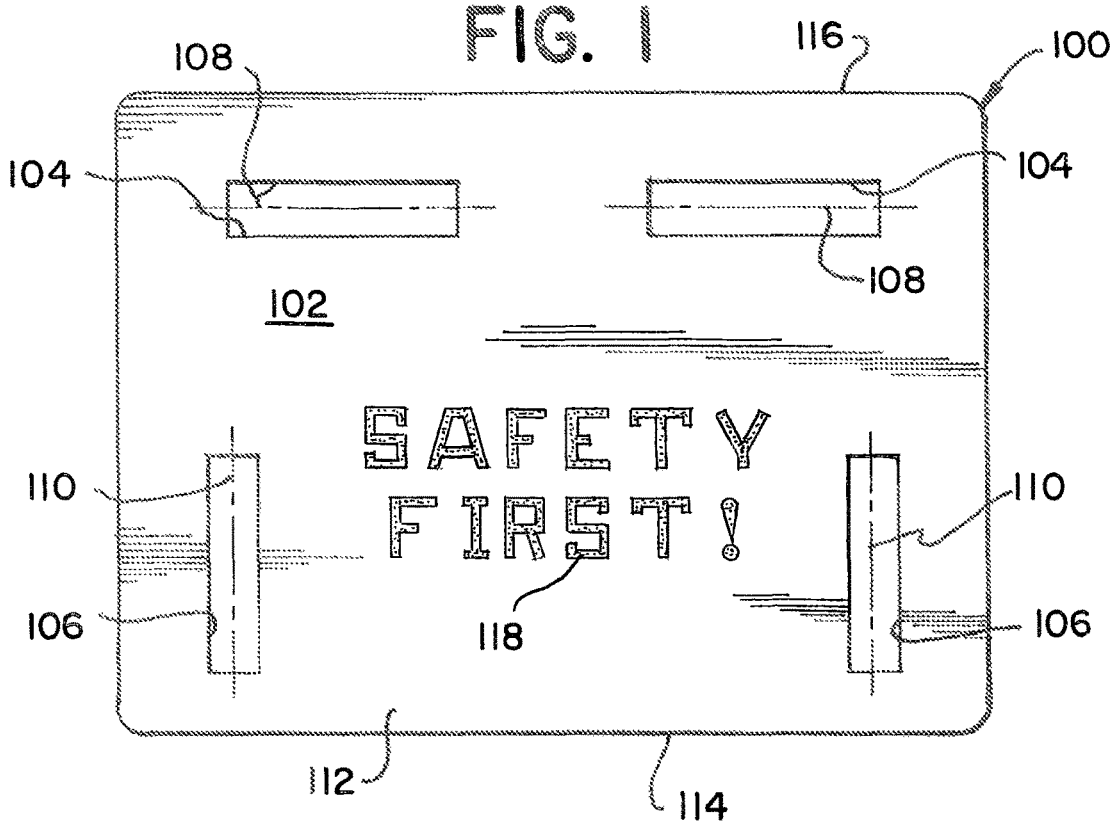
FIG. 1 is an illustration of a basic example of the ladder accessory, in accordance with the present disclosure.

Referring now to the Figures, in which like reference numerals represent like parts, various embodiments of the computing devices and methods will be disclosed in detail.

FIG. 1 is an illustration of a basic example of the ladder accessory 100. The ladder accessory 100 includes a substantially rigid, substantially flat sheet 102. The sheet 102 includes a first group of mounting slots 104 and a second group of mounting slots 106. The first group of mounting slots 104 has a long axis 108 parallel to a first direction. The second group of mounting slots 106 has a long axis 110 parallel to a second direction. The first and second directions are not parallel. In this example, the first direction is perpendicular to the second direction.

In this example, the long axis 108 of the first group of mounting slots 104 and the long axis 110 of the second group 106 of mounting slots are parallel to a primary plane 112 of the substantially rigid, substantially sheet. In FIG. the primary plane 112 of the substantially rigid, substantially sheet is the plane of the page.

The flat sheet 102 has a top edge 116 and a bottom edge 114 which is parallel to the top edge 116. In this example, the long axis 108 of the first group of mounting slots 104 is parallel to the top edge 116 and the bottom edge 114 of the flat sheet 102.

Figure 2:
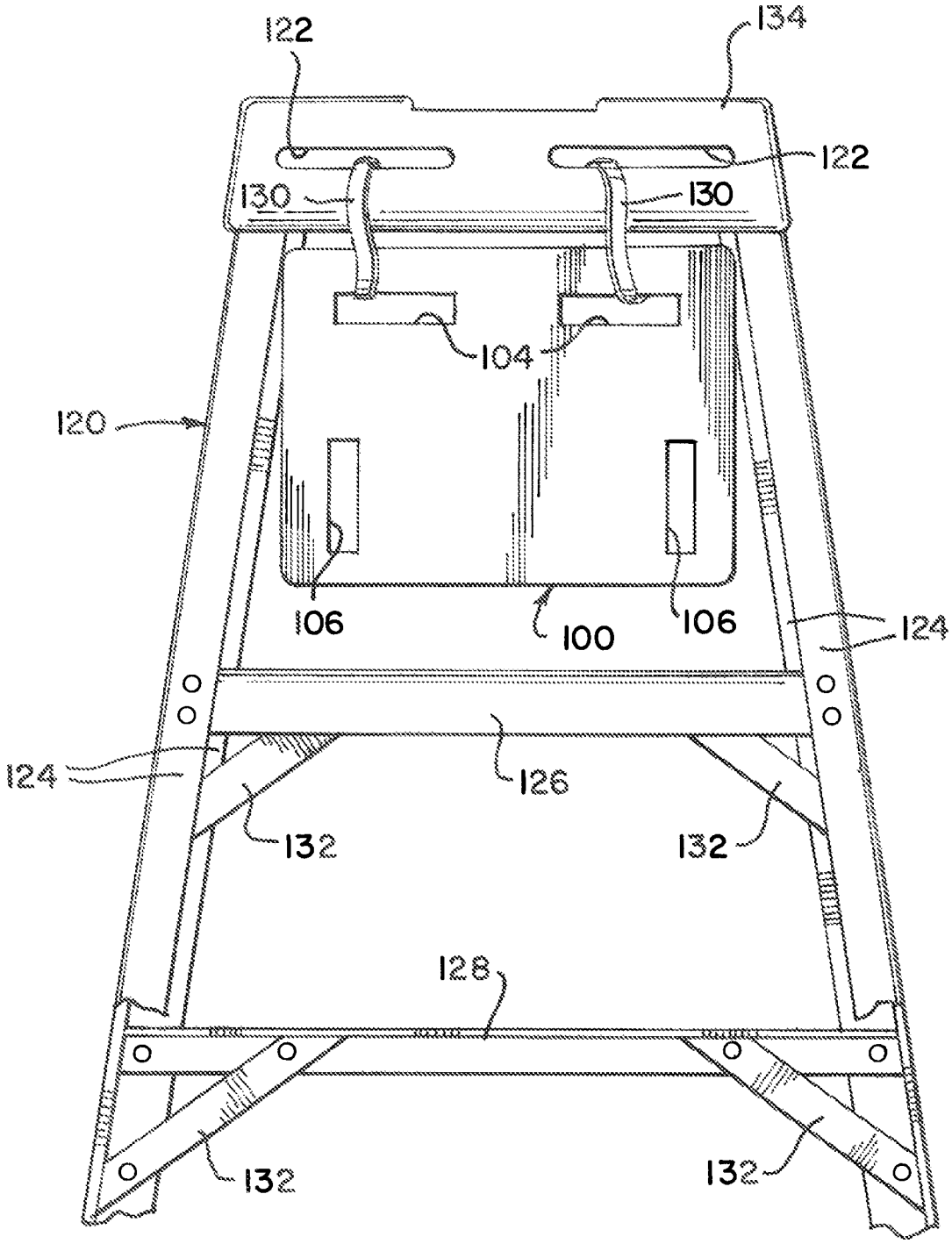
FIG. 2 is an illustration of the ladder accessory attached to a stepladder, in accordance with the present disclosure.

FIG. 2 is an illustration of the ladder accessory 100 attached to a stepladder 120. The stepladder may include a slots or holes 122 in the top cap 134 of the ladder. The ladder accessory 100 may be attached to the ladder slots 122 using wire ties 130, clips (not shown), string (not shown), or carabiners (not shown) placed through the ladder slots 122 and the first group of mounting slots 104. As seen in the figure, the length of the first group of mounting slots 104 can accommodate a wide variety in positioning of the ladder slots 122 or holes.

The ladder accessory 100 may also be attached to the legs 124 of the ladder 120 through the second group of mounting slots 106. This attachment could supplement attachment though the first group of mounting slots 104, or could replace that attachment, especially if the accessory is mounted in the opposite orientation, with the first group of mounting slots 104 toward the bottom. As will be understood by those skilled in the art, the adaptability of the ladder accessory permits many other configurations depending on the geometry of the ladder 120. For example, the ladder accessory 100 could also be attached to the ladder's steps 126, gussets 132, or backside-braces 128.

Figure 3:
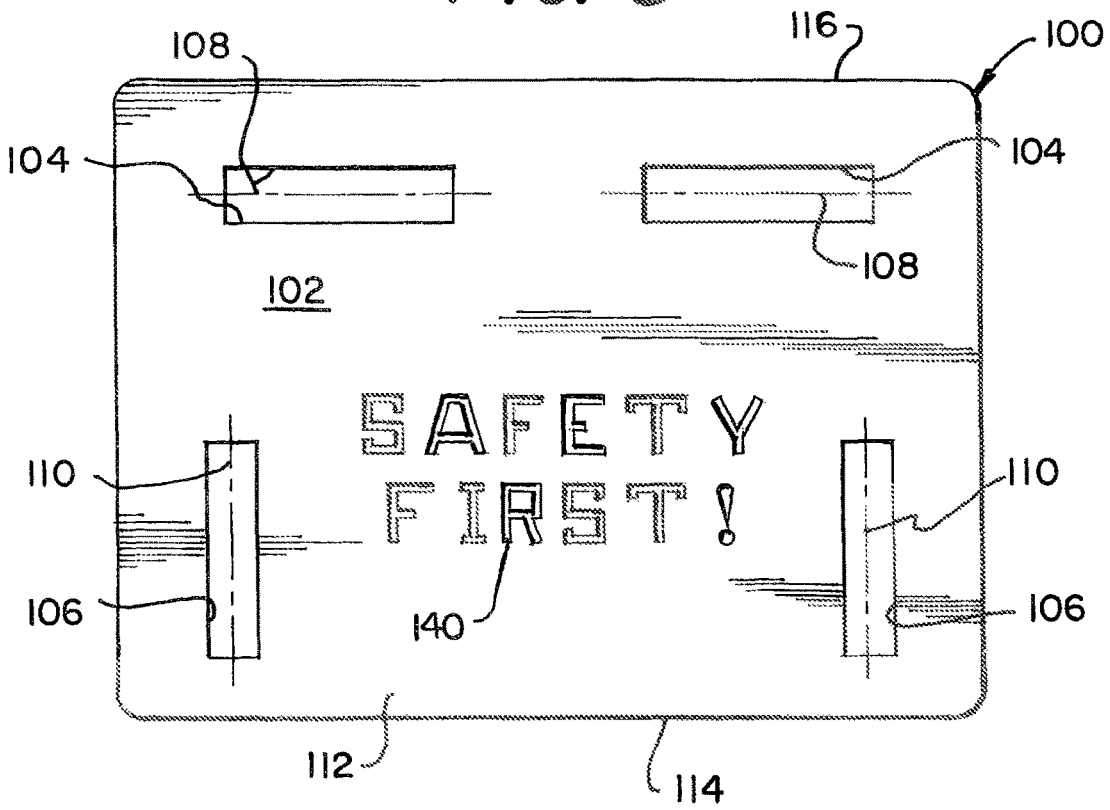
FIG. 3 is an illustration of an example of the ladder accessory which has letter-shaped holes, forming a message, in accordance with the present disclosure.

FIG. 3 is an illustration of an example of the ladder accessory which has letter-shaped holes, forming a message. The third group of holes 140 may be shaped as letters, numbers, symbols, or a combination of the three. For example, the ladder accessory 100 may include a safety message 142 and safety graphic (not pictured) to encourage safe ladder use in the workplace. The third group of holes 140 may be molded or cast into the ladder accessory, as will be described below.

Figure 4:
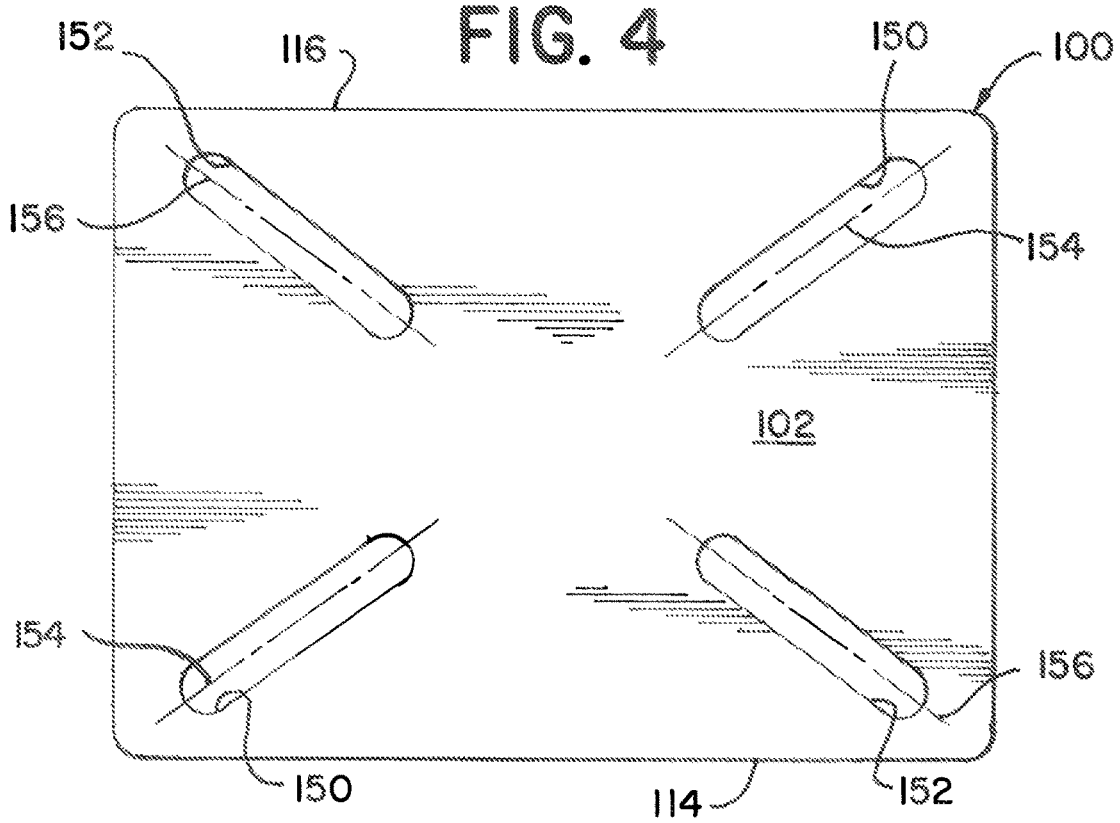
FIG. 4 is an illustration of an example of the ladder accessory where the mounting slots are not parallel to any edge of the accessory, in accordance with the present disclosure.

FIG. 4 is an illustration of an example of the ladder accessory where the mounting slots are not parallel to any edge of the accessory. In this example, the first group of mounting slots 150 has a long axis 154 parallel to a first direction. The second group of mounting slots 152 has a long axis 156 parallel to a second direction. The first and second directions are not parallel or perpendicular to each other or to the edges of the sheet 102. This example, may provide additional mounting flexibility, particularly when the ladder accessory 100 is mounted to a top or bottom surface of a ladder's legs 124, instead of between them as shown in FIG. 2.

Figure 5:
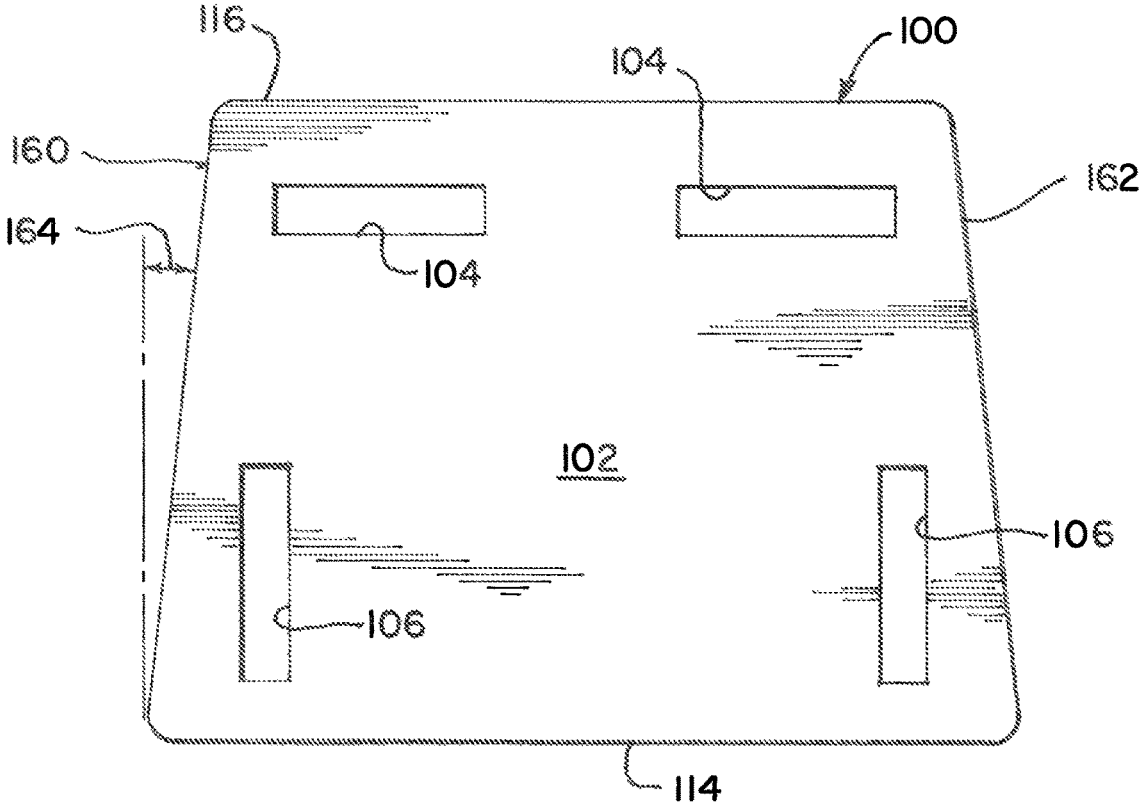
FIG. 5 is an illustration of an example of the ladder accessory having a trapezoidal shape, in accordance with the present disclosure.

FIG. 5 is an illustration of an example of the ladder accessory having a trapezoidal shape. The top edge 116 and bottom edge 114 remain parallel to each other, but the left-side edge 160 and right-side edge 162 are not perpendicular to the top edge 116 and bottom edge 114. The left-side edge 160 and right-side edge 162 are also not parallel to each other. This example may be particularly useful of the angle 164 of the left-side and right-side edges 160, 162 to the top and bottom edges 114, 116 matches the angle between the legs of a stepladder 120.

Figure 7:
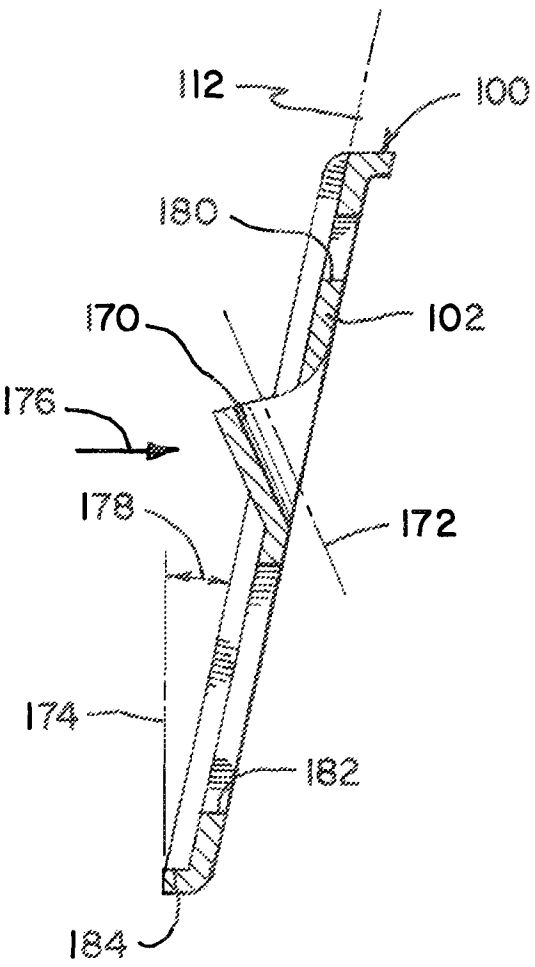
FIG. 7 is an illustration of a cross-section of the ladder accessory in FIG. 6, in accordance with the present disclosure.
Figure 6:
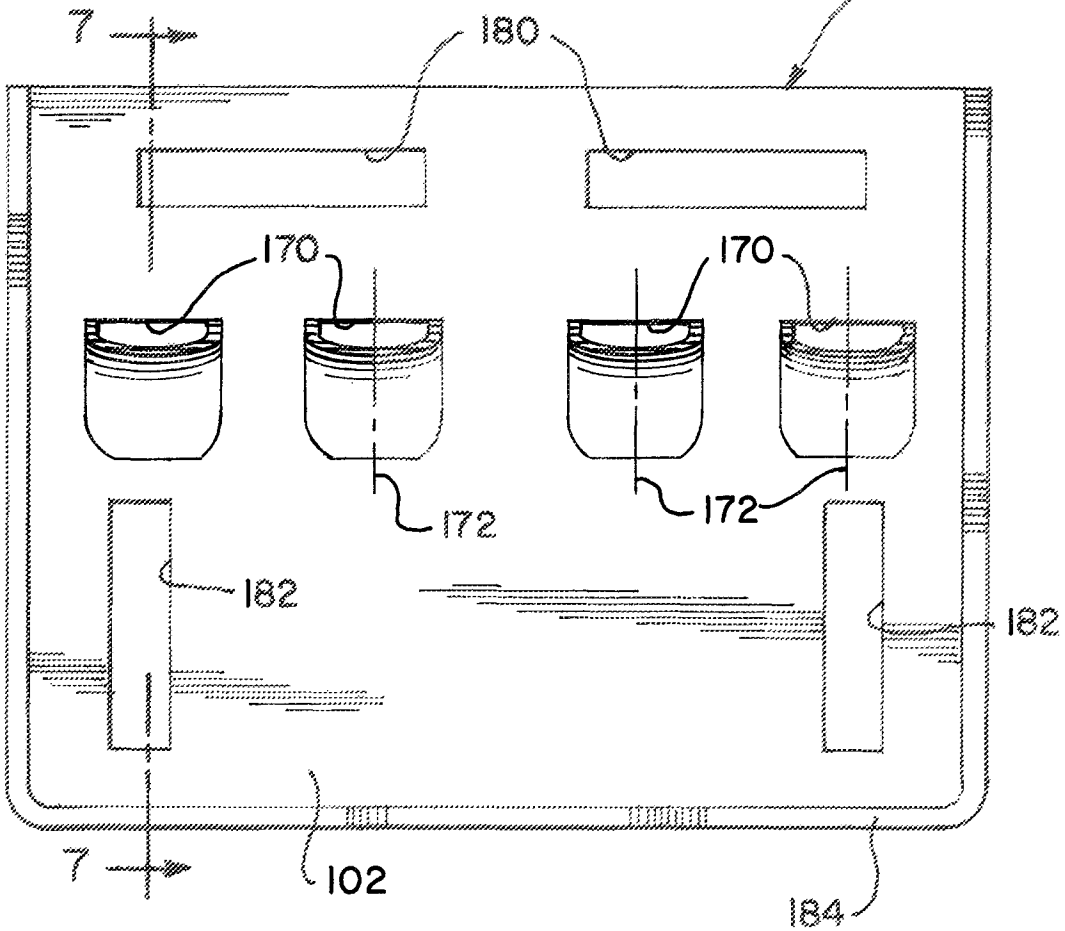
FIG. 6 is an illustration of an example the ladder accessory which has additional holes for holding tools, in accordance with the present disclosure.
Figure 8:
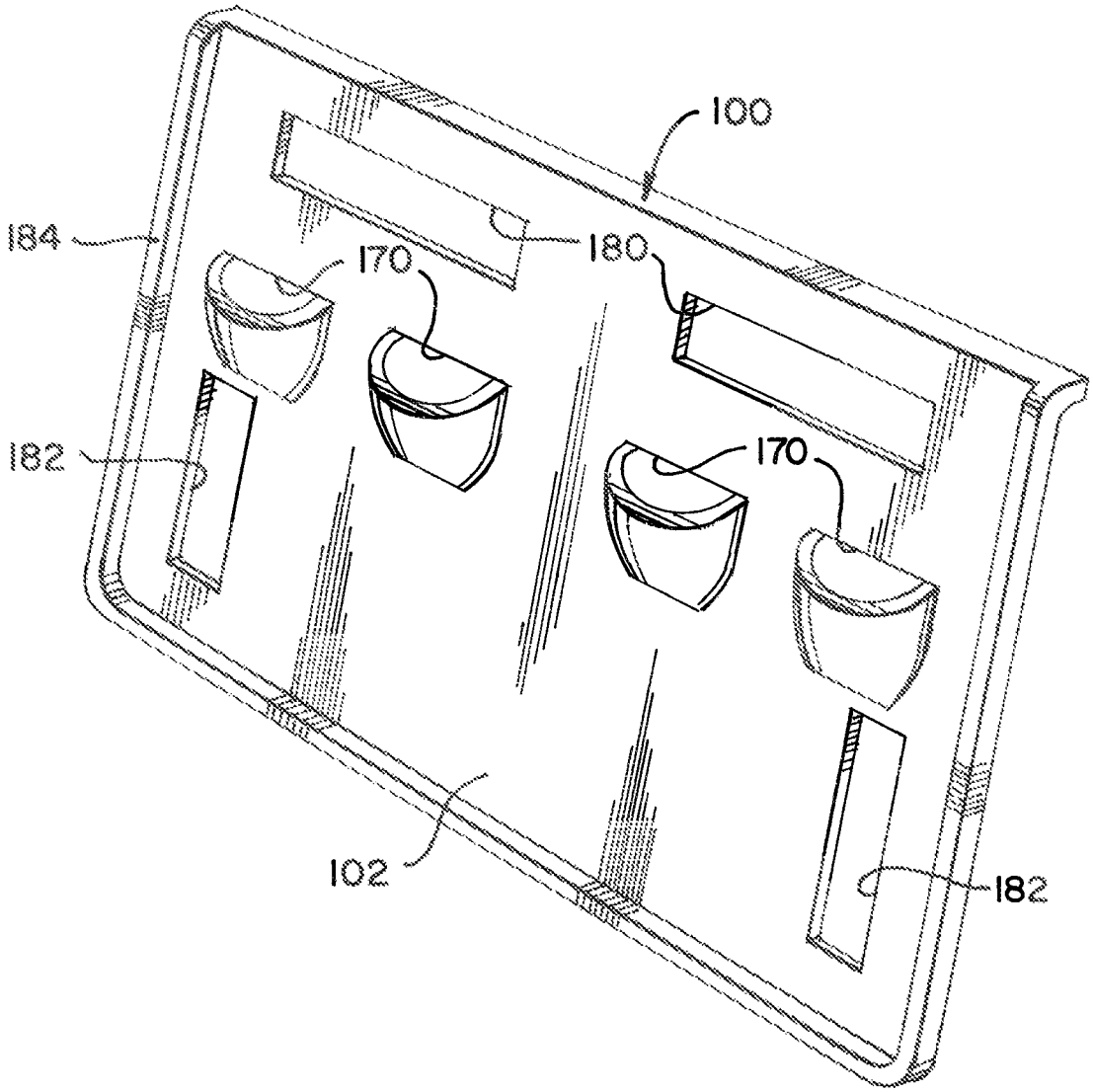
FIG. 8 is an isometric illustration of the example ladder accessory in FIG. 6, in accordance with the present disclosure.

FIG. 6 is an illustration of an example the ladder accessory 100 which has additional holes 170 for holding tools (not shown). Each of the additional holes 170 may be symmetrical about an axis 172 of that hole 170 in one or more directions (left-right, front/back, etc.) FIG. 7 shows a cross-section of the ladder accessory in FIG. 6. As seen in FIG. 7, the additional holes 170 have axes 172 which are not perpendicular to the primary plane 112 of the sheet 102. In one example, the ladder accessory 100 may be designed for mounting to a ladder 120 in a non-vertical orientation. For example, the ladder accessory 100 may be mounted at an angle 178 from a vertical plane 174. This angle 178 may match the angle from vertical of legs 124 of a deployed stepladder 120. Alternately, the angle 178 may match a preferred deployment angle of an extension ladder when it is leaned against a wall.

FIG. 7 also illustrates some features which can improve manufacturability of the ladder accessory 100. In particular, if the ladder accessory 100 is to be molded or cast in a mold or die (collectively, "tools," as will be understood by those skilled in the art), the tool may have an opening direction 176. It is desirable that no undercuts be required in the tool in the opening direction 176. Thus, if the ladder accessory 100 is to be inclined 178 relative to the vertical plane 174 as described above, the interior surfaces 180, 182 of the mounting holes will be substantially parallel to the tool-opening direction 176 which will not be perpendicular to the primary plane 112 of the sheet 102. Additionally, because the axes 172 of the additional holes 170 are not perpendicular to the primary plane 112 of the sheet 102, these features can be formed in the tool by means of a bypass-cutoff, which does not require an undercut, as will be understood by those skilled in the art. FIG. 7 also illustrates how a rib 184 may be formed around the edge of the inclined ladder accessory 100 without requiring an undercut.

The ladder accessory 100 may be made of a polymer, wood, metal, or a combination of the three. In one example, the ladder accessory may be partially or entirely molded from a polymer. The polymer may be a thermoplastic, such as inexpensive polyethylene (PE) and polypropylene (PP), or impact-resistant polycarbonate (PC). The polymer may be a thermoset, such as a urethane or an epoxy. Both thermoplastic and thermoset polymers may reinforced with fibers, such as glass fibers. Both thermoplastic and thermoset polymers may be painted treated, or include additives to resist ultraviolet radiation.

The ladder accessory 100 may alternately be made of wood. The wood may be cut on a router, for example a computer-numeric controlled (CNC) router. Or the ladder accessory 100 may alternately be made of wood fibers or bound by a suitable adhesive, such as epoxy. In such an example, the wood-adhesive composite could also be molded.

The ladder accessory 100 may alternately be made of metal. The ladder accessory 100 could be cut in a flat shape with a CNC laser cutter, plasma cutter, or water jet cutter. Alternately, the ladder accessory 100 could be punched an embossed in a metal-stamping die, progressive die, or rotary-turret CNC stamping machine. Alternately, the ladder accessory 100 could cast, for example as die-cast aluminum or zinc.

To facilitate an understanding of the principals and features of the disclosed technology, illustrative embodiments are explained above. The components described hereinafter as making up various elements of the disclosed technology are intended to be illustrative and not restrictive. Many suitable components that would perform the same or similar functions as components described herein are intended to be embraced within the scope of the disclosed electronic devices and methods. Such other components not described herein may include, but are not limited to, for example, components developed after development of the disclosed technology.

It must also be noted that, as used in the specification and the appended claims, the singular forms "a," "an" and "the" include plural referents unless the context clearly dictates otherwise.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

The design and functionality described in this application is intended to be exemplary in nature and is not intended to limit the instant disclosure in any way. Those having ordinary skill in the art will appreciate that the teachings of the disclosure may be implemented in a variety of suitable forms, including those forms disclosed herein and additional forms known to those having ordinary skill in the art. For example, one skilled in the art will recognize that executable instructions may be stored on a non-transient, computer-readable storage medium, such that when executed by one or more processors, causes the one or more processors to implement the method described above.

While certain embodiments of this disclosure have been described in connection with what is presently considered to be the most practical and various embodiments, it is to be understood that this disclosure is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the technology and also to enable any person skilled in the art to practice certain embodiments of this technology, including making and using any apparatuses or systems and performing any incorporated methods. The patentable scope of certain embodiments of the technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. An adaptable ladder attachment comprising:

a substantially rigid, substantially flat sheet, the sheet comprising a first plurality of mounting slots and a second plurality of mounting slots, at least one of the mounting slots accommodating an attachment attached to a ladder; where each of the first plurality of mounting lots has a long axis parallel to a first direction; and each of the second plurality of mounting slots has a long axis parallel to a second direction, where the first and second directions are not parallel, a third plurality of holes through the flat sheet, where the third plurality of holes through the flat sheet are substantially symmetrical about a second through axis which is not perpendicular to the primary plane of the flat sheet.

2. The adaptable ladder attachment of claim 1 where the first direction is perpendicular to the second direction.

3. The adaptable ladder attachment of claim 2 where the long axis of the first plurality of mounting slots and the where the long axis of the second plurality of mounting slots are parallel to a primary plane of the substantially rigid, substantially sheet.

4. The adaptable ladder attachment of claim 3 where:

the first plurality of mounting slots further comprises a first plurality of interior surfaces;

the second plurality of mounting slots further comprises a second plurality of interior surfaces;

the first plurality of interior surfaces and the second plurality of interior surfaces are substantially parallel to a first through axis which is not perpendicular to the primary plane of the flat sheet.

5. The adaptable ladder attachment of claim 1 where the long axis of the first plurality of mounting slots and the where the long axis of the second plurality of mounting slots are parallel to a primary plane of the substantially rigid, substantially sheet.

6. The adaptable ladder attachment of claim 1 where the flat sheet has a top edge and a bottom edge parallel to the top edge and the long axis of the first plurality of mounting slots is parallel to the top and bottom edges of the flat sheet.

7. The adaptable ladder attachment of claim 1 where the flat sheet has a top edge and a bottom edge parallel to the top edge and the long axis of the first plurality of mounting slots is perpendicular to the top and bottom edges of the flat sheet.

8. The adaptable ladder attachment of claim 1 where the third plurality of holes through the flat sheet are configured to hold tools when the adaptable ladder attachment is attached to a ladder.

9. The adaptable ladder attachment of claim 1 where the adaptable ladder attachment comprises a polymer.

10. The adaptable ladder attachment of claim 9 where the adaptable ladder attachment comprises a molded polymer.

11. The adaptable ladder attachment of claim 10 where the molded polymer is impact resistant.

12. The adaptable ladder attachment of claim 1 further comprising embossed letters, numbers, or symbols.

* * * * *